US011982507B2

(12) United States Patent
Liao

(10) Patent No.: US 11,982,507 B2
(45) Date of Patent: May 14, 2024

(54) CONDUCTING HINGE DEVICE AND ELECTRIC TOY GUN HAVING THE SAME

(71) Applicant: GUAY GUAY TRADING CO., LTD., New Taipei (TW)

(72) Inventor: Yin-Hsi Liao, Changhua County (TW)

(73) Assignee: GUAY GUAY TRADING CO., LTD., New Taipei (TW)

( * ) Notice: Subject to any disclaimer, the term of this patent is extended or adjusted under 35 U.S.C. 154(b) by 203 days.

(21) Appl. No.: 17/846,553

(22) Filed: Jun. 22, 2022

(65) Prior Publication Data

US 2023/0045837 A1 Feb. 16, 2023

(30) Foreign Application Priority Data

Aug. 13, 2021 (TW) ..... 110129964

(51) Int. Cl.

| | |
|---|---|
| ***F41B 11/89*** | (2013.01) |
| ***F41B 4/00*** | (2006.01) |
| ***F41B 7/08*** | (2006.01) |
| ***F41C 23/04*** | (2006.01) |

(52) U.S. Cl.

CPC ..... *F41B 4/00* (2013.01); *F41C 23/04* (2013.01)

(58) Field of Classification Search

CPC .... F41B 11/89; F41B 4/00; F41B 7/08; F41A 11/04; F41C 23/04; E05D 11/0081

USPC ..... 446/473; 124/1; 42/75.04; 439/31

See application file for complete search history.

(56) References Cited

U.S. PATENT DOCUMENTS 2,452,668 A * 11/1948 Lee ..... F41B 7/003 124/37
3,190,978 A * 6/1965 Huget ..... H01R 13/62 439/31
3,256,632 A * 6/1966 Beretta ..... F41C 23/06 42/72
3,262,440 A * 7/1966 Kuhn ..... F41B 11/51 124/67
4,426,910 A * 1/1984 Speer ..... F41F 3/0455 89/1.816
4,878,305 A * 11/1989 Gabrielidis ..... F41A 19/09 42/118
6,280,258 B1 * 8/2001 Frohlund ..... H04M 1/0216 439/31
6,543,173 B1 * 4/2003 Golan ..... F41C 9/00 89/14.05
6,715,227 B2 * 4/2004 Swain ..... F41G 1/41 42/129

(Continued)

FOREIGN PATENT DOCUMENTS

CN 207976050 10/2018

*Primary Examiner* — Alexander R Niconovich
(74) *Attorney, Agent, or Firm* — Burris Law, PLLC

(57) ABSTRACT

A conducting hinge device is adapted to be mounted to an electric toy gun that includes a first body-section, a second body-section pivotally connected to the first body-section, an electric motor unit, and a battery unit. The conducting hinge device includes a conducting unit and a hinge conductor unit. The conducting unit is installed between the first body-section and the second body-section, and includes two pin members for being electrically connected to the electric motor unit. The hinge conductor unit includes two hinge leaves that are mounted co-movably to the second body-section, and that are each sleeved on a respective one of the pin members and electrically connected to the battery.

10 Claims, 8 Drawing Sheets

(56) References Cited

U.S. PATENT DOCUMENTS

| | | | | |
|---|---|---|---|---|
| 6,901,691 | B1 * | 6/2005 | Little | F41G 1/41 42/118 |
| 7,338,288 | B1 * | 3/2008 | Kung | F41A 19/60 439/31 |
| 7,360,478 | B2 * | 4/2008 | Compton | F41A 35/06 42/105 |
| 7,437,847 | B1 * | 10/2008 | Mabry | F41C 23/04 42/73 |
| 7,552,557 | B1 * | 6/2009 | Mabry | F41A 11/04 42/71.01 |
| 8,635,798 | B2 * | 1/2014 | Mulfinger | H01R 13/24 42/84 |
| 8,721,355 | B2 * | 5/2014 | Belack | H01R 13/44 439/141 |
| 9,395,150 | B2 * | 7/2016 | Park | F41G 1/38 |
| 9,506,708 | B2 * | 11/2016 | Peterson | F41A 11/02 |
| 10,156,421 | B2 * | 12/2018 | Smith | F41C 23/14 |
| 10,801,800 | B1 * | 10/2020 | Chia | F41C 23/16 |
| 11,029,109 | B2 * | 6/2021 | Golan | F41C 23/04 |
| 11,156,426 | B2 * | 10/2021 | Chia | F41C 23/16 |
| 2019/0346231 | A1 * | 11/2019 | Ma | F41A 11/04 |
| 2021/0003363 | A1 * | 1/2021 | Chia | F41G 1/46 |

* cited by examiner

CONDUCTING HINGE DEVICE AND ELECTRIC TOY GUN HAVING THE SAME

CROSS-REFERENCE TO RELATED APPLICATION

This application claims priority to Taiwanese Invention Patent Application No 110129964, filed on Aug. 13, 2021.

FIELD

The disclosure relates to an electric toy gun, and more particularly to an electric toy gun having a conducting hinge device.

BACKGROUND

Conventional toy guns that are foldable are disclosed in, for example, U.S. Pat. No. 3,262,440 and Chinese Patent No. 207976050. Specifically, conventional toy guns often have a foldable stock to reduce the size of the toy gun. The stock can be extended to provide aiming stability, or folded away to shorten the overall length of the toy gun. By having the foldable stock, the toy gun is easier to carry and maneuver for a user. FIG. 1 shows a conventional electric toy gun 1 including a gun body 11, a foldable stock 12 that is connected to the gun body 11, an electric motor unit 13 that is disposed in the gun body 11 and that is used to convert electric energy to kinetic energy in order to fire a pellet, a battery unit 14 that is disposed in the foldable stock 12 and that is electrically connected to the electric motor unit 13 and that provides electrical energy to the conventional electric toy gun 1, and a set of electric wires 15 that electrically connects the electric motor unit 13 to the battery unit 14. The set of electric wires 15 is fitted loosely with enough tolerance so as to allow the electric motor unit 13 to remain electrically connected to the battery unit 14 when the stock 12 is either folded or expanded, and thereby allow the conventional electric toy gun 1 to remain operational in both the folded and the expanded configurations of the stock 12.

However, when the stock 12 is folded away, a portion of the electric wires 15 will be exposed and will easily get snagged on other objects when the user of the electric toy gun 1 is maneuvering in rough terrain and could cause the electric toy gun 1 to malfunction. Additionally, it is also possible for the electric wires 15 to get caught between the gun body 11 and the stock 12 when folding the foldable stock 12.

SUMMARY

Therefore, an object of the disclosure is to provide a conducting hinge device that can alleviate at least one of the drawbacks of the prior art.

According to the disclosure, a conducting hinge device is adapted to be mounted to an electric toy gun. The electric toy gun includes a first body-section, a second body-section that is pivotally connected to the first body-section, an electric motor unit that is mounted in the first body-section, and a battery unit that is mounted in the second body-section for providing electric energy to the electric toy gun. The conducting hinge device includes a conducting unit and a hinge conductor unit. The conducting unit is adapted to be installed between the first body-section and the second body-section, and includes two pin members that are electrically conductive and that are spaced apart along an axis. Each of the pin members is adapted to be electrically connected to the electric motor unit. The hinge conductor unit includes two hinge leaves that are adapted to be mounted co-movably to the second body-section and that are electrically conductive. Each of the hinge leaves is sleeved on a respective one of the pin members and is adapted to be electrically connected to the battery.

Another object of the disclosure is to provide an electric toy gun including the abovementioned conductive hinge device.

According to the disclosure, an electric toy gun includes a first body-section, a second body-section, an electric motor unit, a battery unit, and the abovementioned conducting hinge device. The first body-section has a first plate surface. The second body-section is pivotally connected to the first body-section and has a second plate surface. The second body-section is pivotable relative to the first body-section between an extended position, where an angle between the first plate surface and the second plate surface is substantially zero, and a folded position, where the angle ranges from 90 degrees to 180 degrees. The electric motor unit is mounted in the first body-section for converting electric energy into kinetic energy to propel at least one pellet to be fired from the electric toy gun. The battery unit is mounted in the second body-section and is disposed for providing electric energy.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
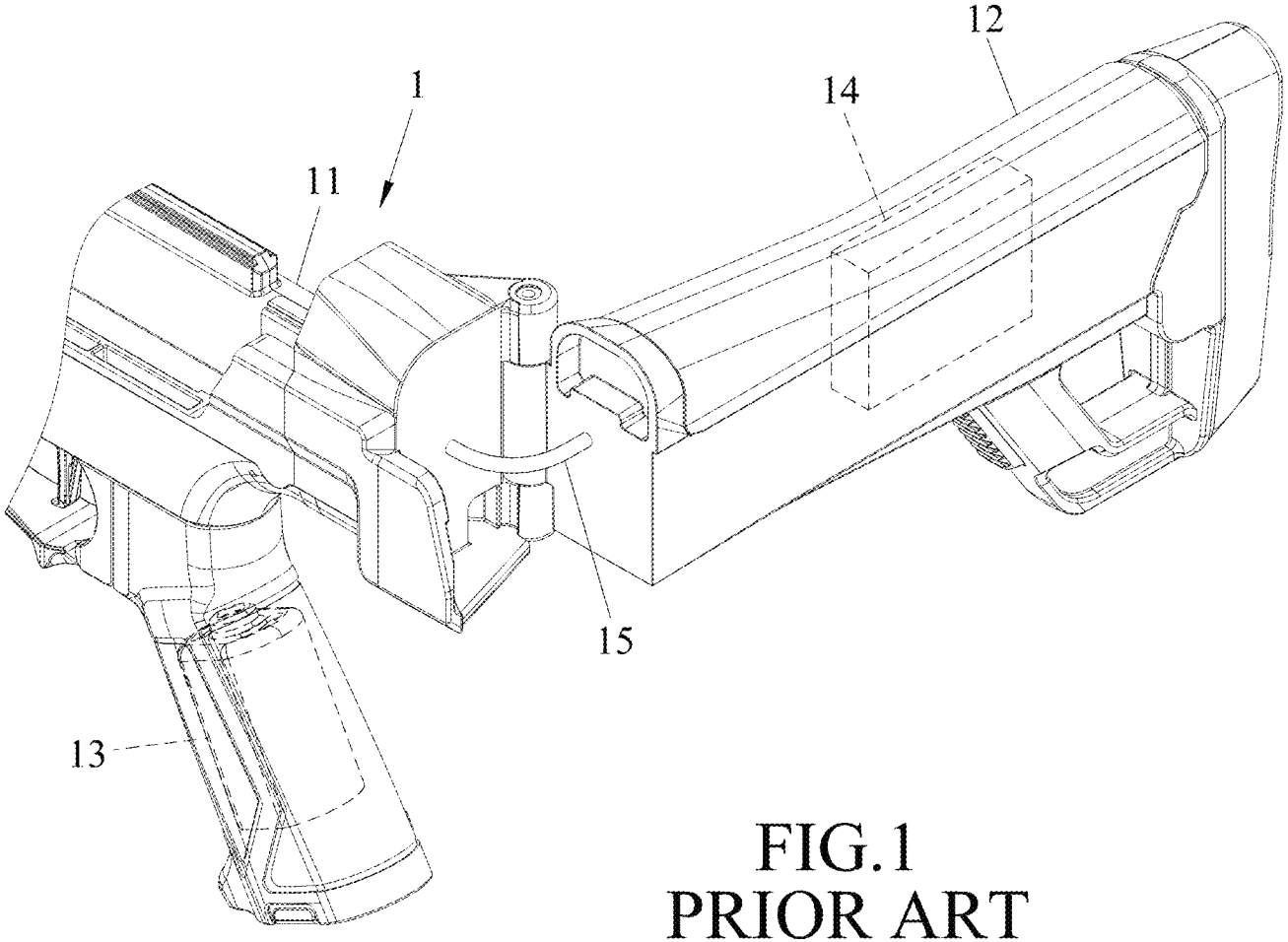
FIG.1 PRIOR ART
FIG. 1 is a fragmentary perspective view illustrating a conventional electric toy gun with a foldable stock.
Figure 2:
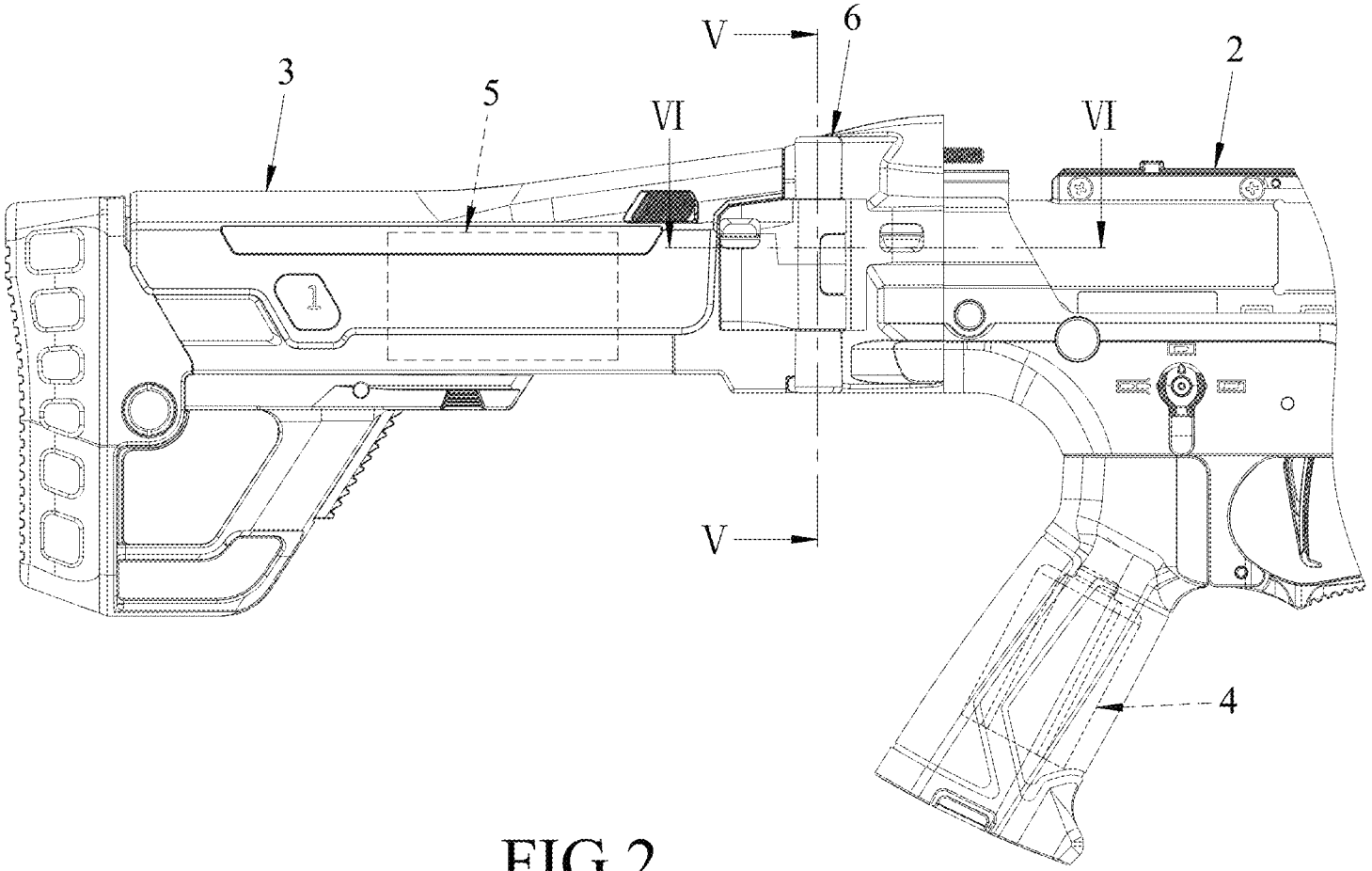
FIG. 2 is a fragmentary side view illustrating an embodiment of an electric toy gun according to the present disclosure.
Figure 3:
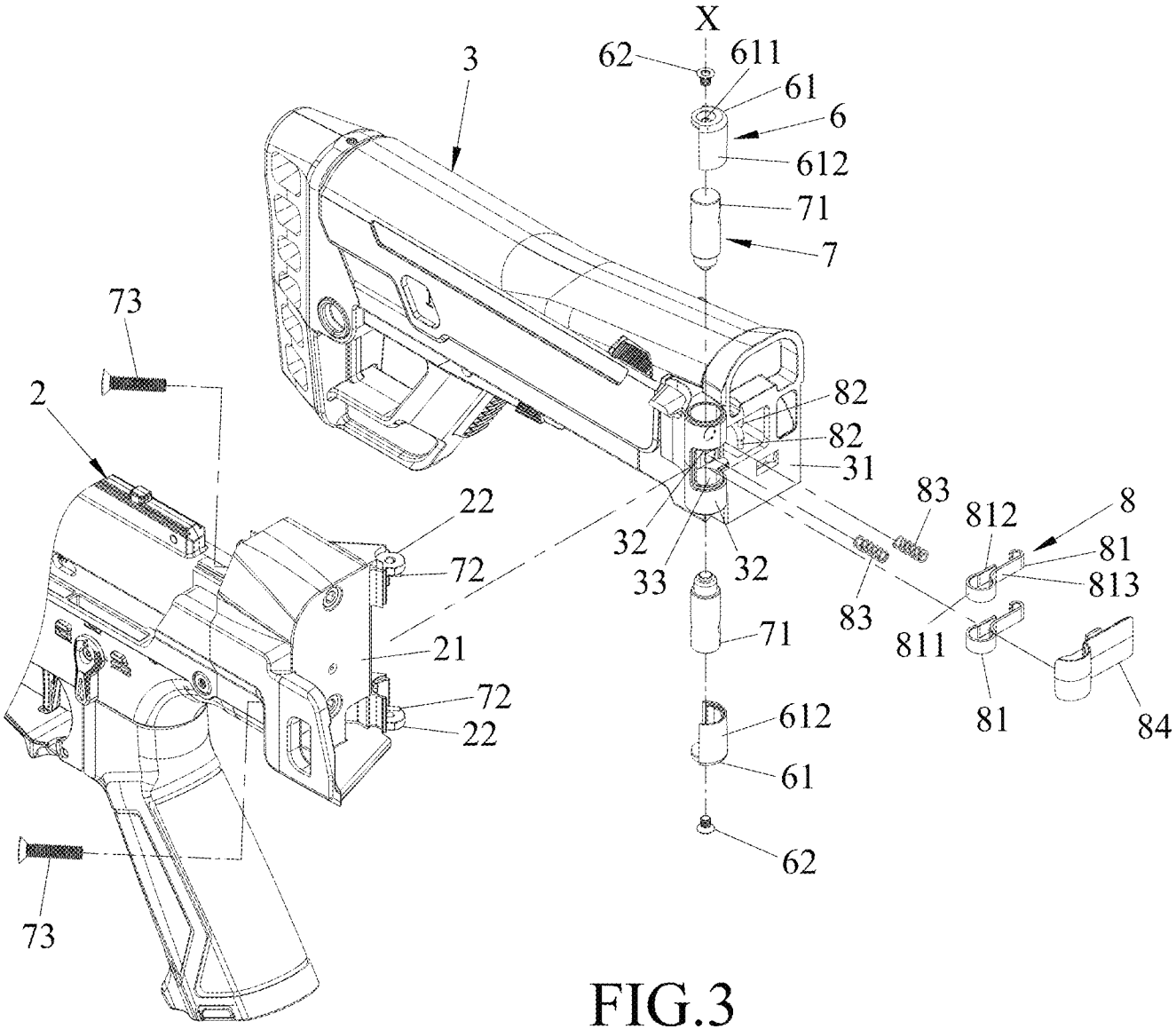
FIG. 3 is a fragmentary partly exploded perspective view of the embodiment.
Figure 4:
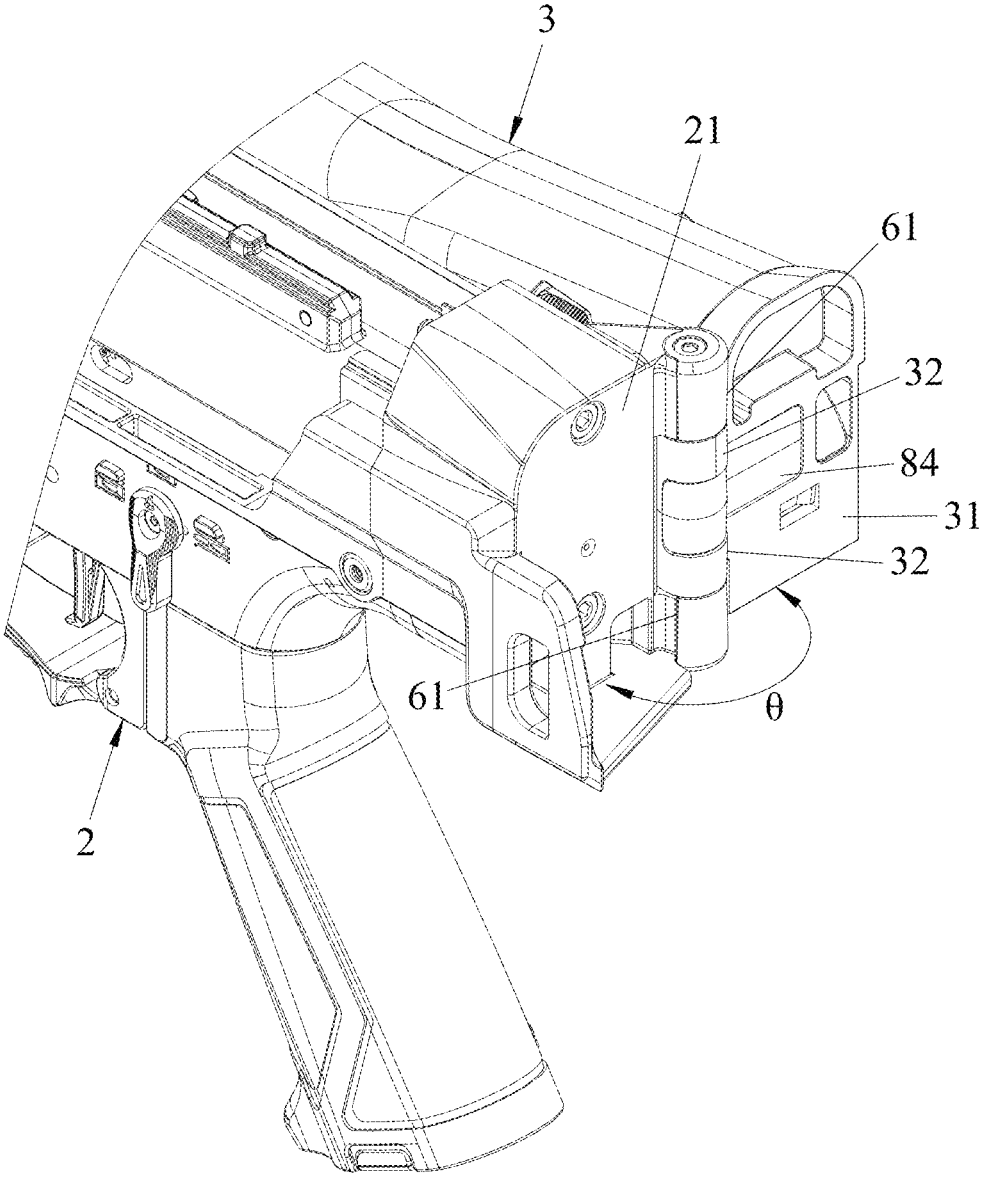
FIG. 4 is a fragmentary perspective view of the embodiment.

Referring to FIGS. 2 to 4, a first embodiment of the electric toy gun according to the present disclosure is shown. The electric toy gun includes a first body-section 2, a second body-section 3, an electric motor unit 4, a battery unit 5, a hinge-connecting unit 6, and a conducting hinge device that includes a conducting unit 7 and a hinge conductor unit 8.

The first body-section 2 has a first plate surface 21 and two lugs 22 that are adjacent to the first plate surface 21, and that are spaced apart along an axis (X).

Figure 6:
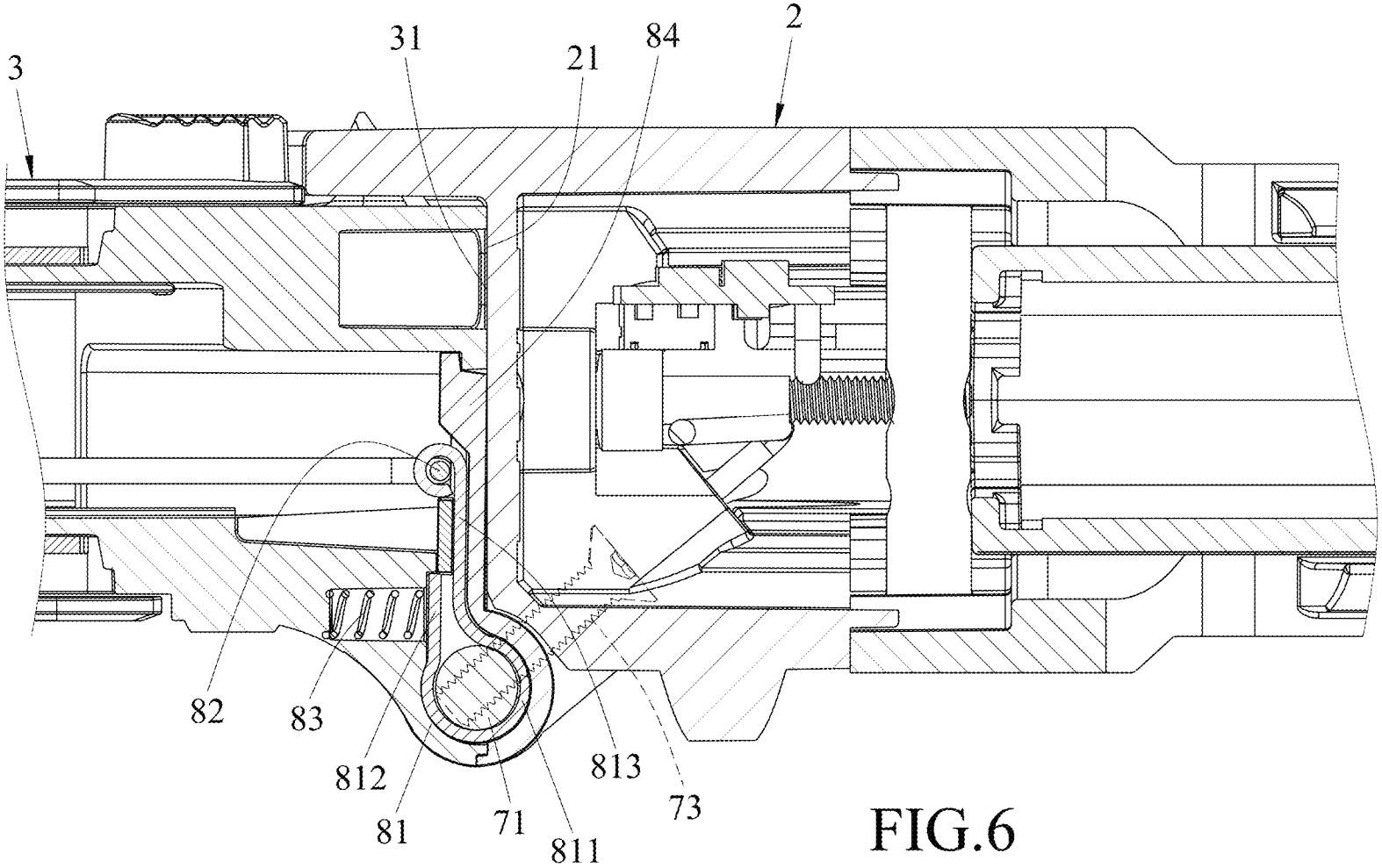
FIG. 6 is a fragmentary cross-sectional view taken along line VI-VI in FIG. 2, and showing a second body-section in an extended position.
Figure 8:
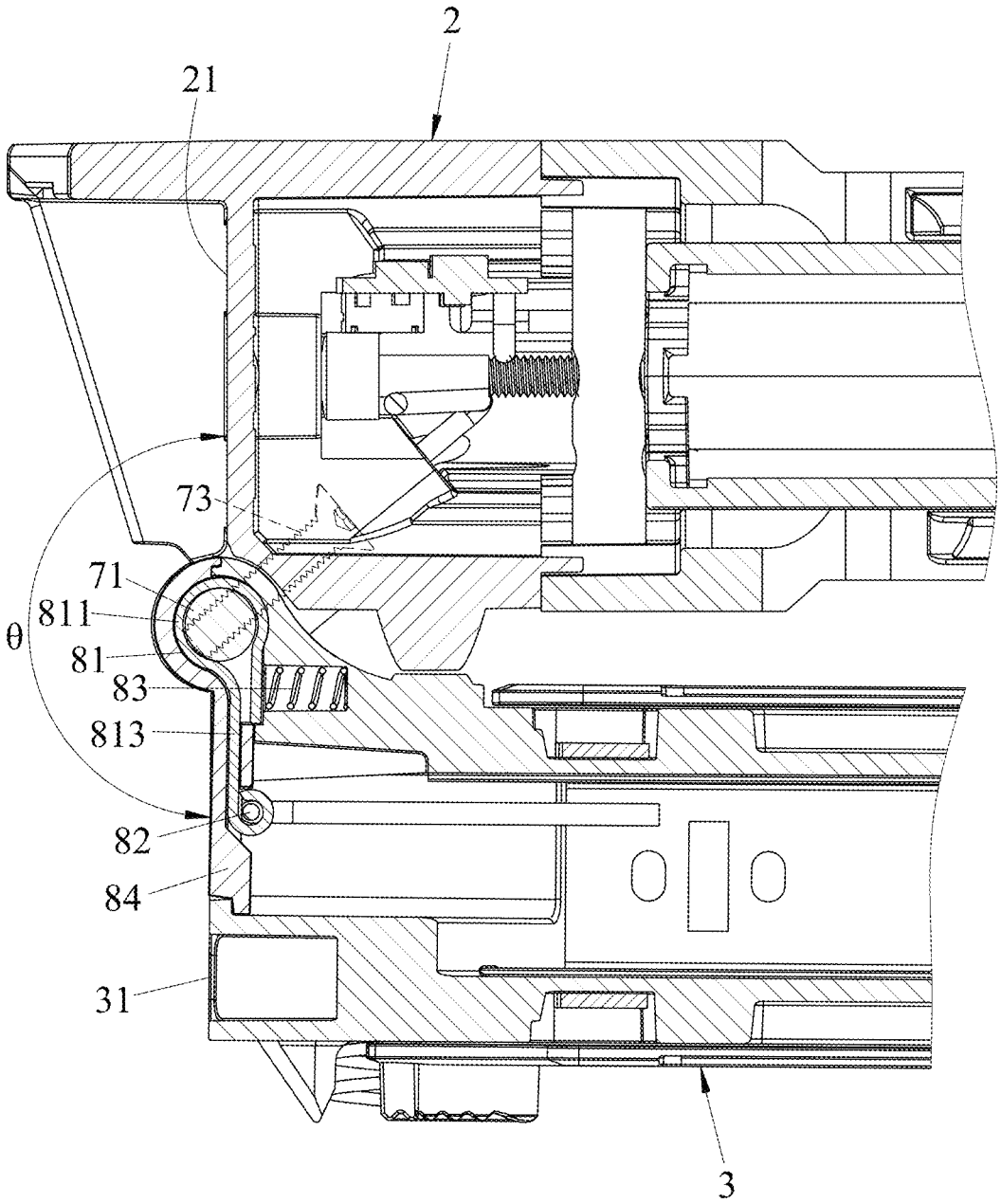
FIG. 8 is a fragmentary cross-section view similar to FIG. 6, but with the second body-section rotated 180 degrees to a folded position.

The second body-section 3 is pivotally connected to the first body-section 2 and has a second plate surface 31 forming an angle (θ) with the first plate surface 21, and two hinge knuckles 32 that are adjacent to the second plate surface 31, that are located between the two lugs 22, that are spaced apart along the axis (X), and that define a knuckle space 33 therebetween. The second body-section 3 is pivotable relative to the first body-section 2 between an extended position (as shown in FIGS. 2 and 6), where the angle (θ) between the first plate surface 21 and the second plate surface 31 is substantially zero, and a folded position, where the angle (θ) ranges from 90 degrees to 180 degrees. It should be noted, that ideally the angle (θ) is 180 degrees as shown in FIGS. 4 and 8 when the second body-section 3 is in the folded position. In this embodiment, the electric toy gun is an electric airsoft rifle with a foldable stock, the first body-section 2 is the rifle body, and the second body-section 3 is the rifle stock. However, this is not a limitation of the present disclosure.

The battery unit 5 (see FIG. 2) is mounted in the second body-section 3, and is disposed for providing electric energy to the electric toy gun. The electric motor unit 4 is mounted in the first body-section 2 for converting electric energy into kinetic energy to propel at least one pellet (not shown) to be fired from the electric toy gun.

Figure 5:
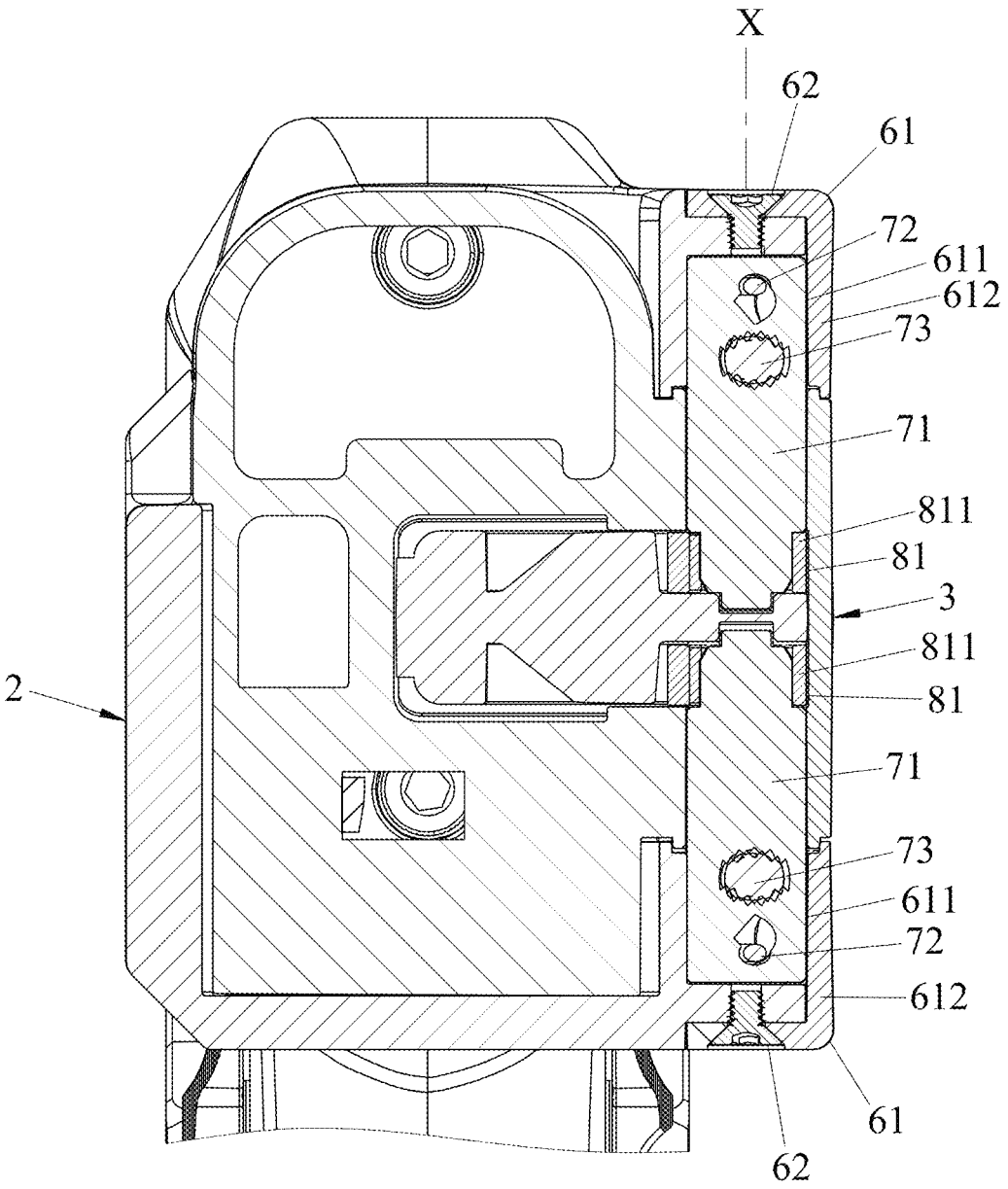
FIG. 5 is a fragmentary cross-sectional view taken along line V-V in FIG. 2.

Referring to FIGS. 3, 5, and 6, the hinge-connecting unit 6 includes two pin seats 61, and two first bolts 62. Each of the pin seats 61 abuts against a respective one of the lugs 22, and has a curved wall 612 that cooperates with the first body section 2 to define a pin hole 611 and that is coupled to a respective one of the hinge knuckles 32. Each of the first bolts 62 interconnect a respective one of the lugs 22 and the respective one of the pin seats 61. The respective hinge knuckles 32 are substantially positioned between the pin seats 61.

The conducting unit 7 is installed between the first body-section 2 and the second body-section 3, and includes two pin members 71 that are electrically conductive, two stationary wires 72, and two second bolts 73.

The two pin members 71 are spaced apart along the axis (X), and each of the pin members 71 is inserted along the axis (X) through a respective one of the hinge knuckles 32 and into the knuckle space 33. More specifically, each of the pin members 71 is inserted through the pin hole 611 defined by the curved wall 612 of a respective one of the pin seats 61 and the first body-section 2, and the respective one of the hinge knuckles 32 and into the knuckle space 33.

Each stationary wire 72 of the conducting unit 7 is electrically connected to a respective one of the pin members 71 and the electric motor unit 4 (see FIG. 2), so that each pin member 71 is electrically connected to the electric motor unit 4. In this embodiment, each stationary wire 72 is inserted into the respective pin member 71.

Each second bolt 73 of the conducting unit 7 is connected to the first body-section 2 and a respective one of the pin members 71 to secure the respective one of the pin members 71 to the first body-section 2. In this embodiment, the two second bolts 73 are immovably and threadedly connected to the respective pin members 71 in a direction perpendicular to the axis (X).

The hinge conductor unit 8 includes two hinge leaves 81, two connecting wires 82, two resilient members 83, and a cover plate 84.

The two hinge leaves 81 are mounted co-movably to the second body-section 3 and are electrically conductive. Each of the hinge leaves 81 is disposed in the knuckle space 33, is sleeved on a respective one of the pin members 71, and is electrically connected to the battery unit 5. More specifically, each of the two hinge leaves 81 is rotatably sleeved on the respective one of the pin members 71, and has a surrounding portion 811 disposed in the knuckle space 33 and surrounding the respective one of the pin members 71, an abutting portion 812 extending from one end of the surrounding portion 811 and abutting against the second body-section 3, and a conducting portion 813 extending from another end of the surrounding portion 811 and being parallel to the surrounding portion 812.

Each of the connecting wires 82 is electrically connected to a respective one of the hinge leaves 81 and the battery unit 5. More specifically, each of the connecting wires 82 is electrically connected to the conducting portion 813 of the respective one of the hinge leaves 81 and the battery unit 5.

Each of the two resilient members 83 is disposed between and abutting against the second body-section 3 and the abutting portion 812 of a respective one of the hinge leaves 81 for applying a biasing force so that the respective one of the hinge leaves 81 maintains electrical contact with the respective one of the pin members 71.

The cover plate 84 of the conductor unit 8 is removably mounted on the second body-section 3 and covers the hinge leaves 81.

Referring to FIGS. 5 and 6, when the second body-section 3 is in the extended position (i.e., the second plate surface 31 of the second body-section 3 and the first plate surface 21 of the first body-section 2 are facing each other and the angle (θ) is substantially zero), the second body-section 3 can be used as the rifle stock by a user to brace against to provide more stability when aiming the electric toy gun.

At this time, the conducting portions 813 of the hinge leaves 81 are positioned between the first plate surface 21 and the second plate surface 31. An electric current from the battery unit 5 will flow through one of the connecting wires 82, one of the hinge leaves 81, one of the pin members 71, one of the stationary wires 72, to the electric motor unit 4 (see FIG. 2). From the electric motor unit 4 the current will flow to the other stationary wire 72, the other pin member 71, the other hinge leaf 81, the other connecting wire 82, and back to the battery unit 5 in a closed loop which forms an electric circuit. The toy gun is thus provided with electrical energy for its operation.

Figure 7:
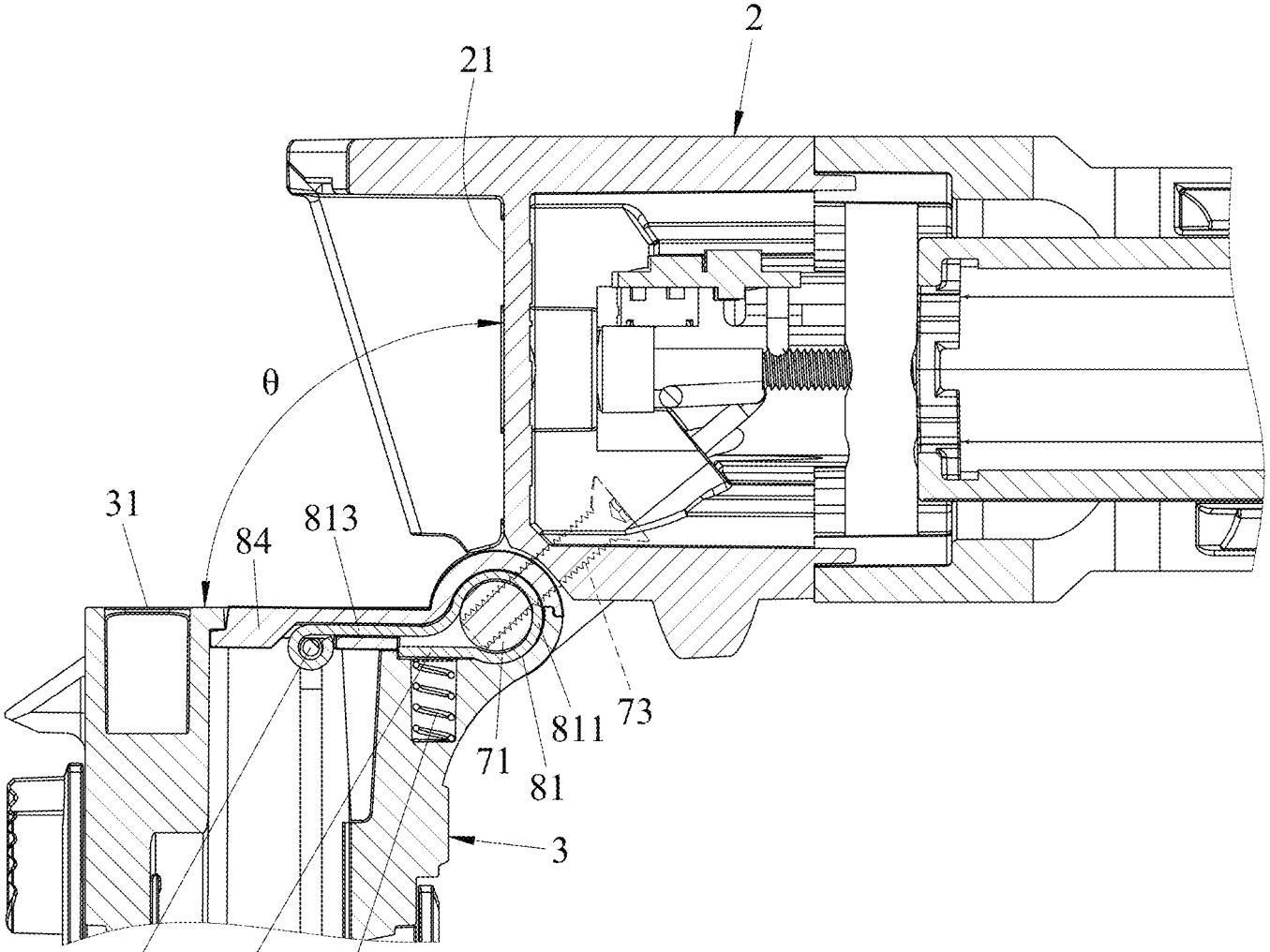
FIG. 7 is a fragmentary cross-sectional view similar to FIG. 6, but with the second body-section rotated 90 degrees.

Referring to FIGS. 5, 7 and 8, the second body-section 3 can pivot relative to the first body-section 2 so that the angle (θ) between the first plate surface 21 of the first body-section 2 and the second plate surface 31 of the second body-section 3 may be 90 degrees as shown in FIG. 7, or 180 degrees as shown in FIG. 8. When the second body-section 3 is moving between these angles, the hinge leaves 81 are secured to the second body-section 3 by the cover plate 84, and will pivot along with the second body-section 3 using the pin members 71 (along the axis (X)) as a center of rotation. In this way, electrical contact can be maintained when the second body-section 3 is being folded, and the current supplied by the battery unit 5 can continue to flow through the previously described electric circuit, which will allow the electric toy gun to remain operational when the second body-section 3 is being folded.

When the second body-section 3 is in the folded position (i.e., the angle (θ) between the first plate surface 21 of the first body-section 2 and the second plate surface 31 of the second body-section 3 is 180 degrees), the first body-section 2 is parallel to the second body-section 3, which reduces the overall length of the electric toy gun, saves space and provides more maneuverability to the user.

The advantages of the embodiment are as follows:

By having the hinge leaves 81 that are rotatably sleeved on the pin members 71 and that are able to pivot with the second body-section 3, electric connections in the electric toy gun can be maintained when the second body-section 3 is moving between the extended and the folded positions. Additionally, by having the conducting unit 7 and the hinge conductor unit 8 function as part of the pivoting (hinge) mechanism while being electrically conductive, the electric toy gun according to the present disclosure can operate without exposed electric wires connected between the first body-section 2 and the second body-section 3. By not having exposed electric wires, the electric toy gun is more maneuverable when carried by the user as it will not snag unto other objects, also, the foldable mechanism (i.e. the pivot connection between the first body-section 2 and the second body-section 3) of the electric toy gun will function more smoothly without exposed electric wires that may hinder the pivoting movement of the mechanism.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A conducting hinge device adapted to be mounted on an electric toy gun, the electric toy gun including a first body-section, a second body-section that is pivotally connected to the first body-section, an electric motor unit that is mounted in the first body-section, and a battery unit that is mounted in the second body-section for providing electric energy to the electric toy gun, said conducting hinge device comprising:

a conducting unit adapted to be installed between the first body-section and the second body-section, and including two pin members that are electrically conductive and that are spaced apart along an axis, each of said pin members being adapted to be electrically connected to the electric motor unit; and a hinge conductor unit including two hinge leaves that are adapted to be mounted co-movably to the second body-section and that are electrically conductive, each of said hinge leaves being sleeved on a respective one of said pin members and adapted to be electrically connected to the battery.

2. The conducting hinge device as claimed in claim 1, wherein:

said two pin members of said conducting unit are adapted to be immovably connected to the first body-section; and each of said two hinge leaves of said hinge conductor unit is rotatably sleeved on the respective one of said pin members.

3. The conducting hinge device as claimed in claim 1, wherein said conducting unit further includes two stationary wires, each being adapted to be electrically connected to a respective one of said pin members and the electric motor unit.

4. The conducting hinge device as claimed in claim 1, wherein said hinge conductor unit further includes two connecting wires, each being adapted to be electrically connected to a respective one of said hinge leaves and the battery unit.

5. The conducting hinge device as claimed in claim 4, wherein each hinge leaf has:

a surrounding portion surrounding the respective one of said pin members;

an abutting portion extending from one end of said surrounding portion and being adapted to abut against the second body-section; and a conducting portion extending from another end of said surrounding portion, each of said connecting wires being electrically connected to said conducting portion of the respective one of said hinge leaves.

6. The conducting hinge device as claimed in claim 5, wherein said hinge conductor unit further includes a cover plate that is adapted to be removably mounted on the second body-section and that covers said hinge leaves.

7. The conducting hinge device as claimed in claim 5, wherein said hinge conductor unit further includes two resilient members, each being adapted to be disposed between and abut against the second body-section and said abutting portion of a respective one of said hinge leaves, for applying a biasing force so that the respective one of said hinge leaves maintains electrical contact with the respective one of said pin members.

8. An electric toy gun comprising:

a first body-section having a first plate surface;

a second body-section pivotally connected to said first body-section and having a second plate surface, said second body-section being pivotable relative to said first body-section between an extended position, where an angle between said first plate surface and said second plate surface is substantially zero, and a folded position, where the angle ranges from 90 degrees to 180 degrees;

an electric motor unit mounted in said first body-section for converting electric energy into kinetic energy to propel at least one pellet to be fired from said electric toy gun;

a battery unit mounted in said second body-section and disposed for providing electric energy; and the conducting hinge device as claimed in claim 1.

9. The electric toy gun as claimed in claim 8, wherein:

said first body-section further has two lugs that are adjacent to said first plate surface and that are spaced apart along the axis;

said second body-section further has two hinge knuckles that are adjacent to said second plate surface, that are located between said two lugs, that are spaced apart along the axis, and that define a knuckle space therebetween;

each of said pin members of said conducting unit is inserted along the axis through a respective one of said hinge knuckles and into said knuckle space; and each of said two hinge leaves of said hinge conductor unit is disposed in said knuckle space and sleeved on the respective one of said pin members.

10. The electric toy gun as claimed in claim 9, wherein:

said electric toy gun further comprises a hinge-connecting unit that includes two pin seats, each abutting against a respective one of said lugs, and having a curved wall that cooperates with said first body-section to define a pin hole and that is coupled to a respective one of said hinge knuckle, and two first bolts, each interconnecting a respective one of said lugs and the respective one of said pin seats;

each of said pin members is inserted through said pin hole defined by said curved wall of a respective one of said pin seats and said first body-section, and the respective one of said hinge knuckles, and into said knuckle space; and said conducting unit further includes two second bolts, each being connected to said first body-section and a respective one of said pin members to secure the respective one of said pin members to said first body-section.

* * * * *